United States Patent [19]

Ichimura et al.

[11] Patent Number: 4,611,867

[45] Date of Patent: Sep. 16, 1986

[54] COAXIAL MULTICORE RECEPTACLE

[75] Inventors: Yoshiaki Ichimura; Hiroshi Endoh; Yoshihiko Saruwatari; Kouzou Uekido, all of Tokyo, Japan

[73] Assignees: Japan Aviation Electronics Industry Limited; NEC Corporation, both of Tokyo, Japan

[21] Appl. No.: 752,690

[22] Filed: Jul. 8, 1985

[51] Int. Cl.[4] ..... H01R 4/66; H01R 23/26

[52] U.S. Cl. ..... 339/14 R; 339/143 R

[58] Field of Search ..... 339/14 R, 143 R

[56] References Cited

U.S. PATENT DOCUMENTS

| | | | |
|---|---|---|---|
| 2,939,100 | 5/1960 | Watts | 339/143 R |
| 3,406,369 | 10/1968 | Taylor, Jr. | 339/143 R |
| 3,418,621 | 12/1968 | Campbell, Jr. | 339/143 R |
| 3,430,183 | 2/1969 | Feeser et al. | 339/143 R |
| 3,432,801 | 3/1969 | Ruotolo | 339/143 R |
| 3,587,028 | 6/1971 | Uberbacher | 339/14 R |
| 4,501,461 | 2/1985 | Anhalt | 339/143 R |

FOREIGN PATENT DOCUMENTS 6068570 4/1985 Japan .

*Primary Examiner*—Gil Weidenfeld

*Assistant Examiner*—Gary F. Paumen

*Attorney, Agent, or Firm*—Pollack, Vande Sande & Priddy

[57] ABSTRACT

A coaxial multicore receptacle is provided which has a plurality of ground pins set upright on an insulating substrate and arranged in a matrix pattern, a plurality of signal pins set upright on the substrate each being located at the center of each box of the matrix pattern, first metallic lattice boards provided perpendicularly to the substrate each being positioned correspondingly to and above each column of the ground pins, and second metallic lattice boards provided perpendicularly to the substrate each being positioned correspondingly to and above each row of the ground pins. The first and second lattice boards cross one another orthogonally to define angular coaxial contact insertion holes surrounded by the boards and arranged in the matrix pattern. Each of the first lattice boards is formed with notches in the end portion on the side of the substrate to provide ground pin contact springs which are in elastic contact with the corresponding ground pins. As a coaxial contact is inserted into one of the coaxial contact insertion holes, a center conductor of the coaxial contact comes into contact with the corresponding signal pin.

18 Claims, 13 Drawing Figures

COAXIAL MULTICORE RECEPTACLE

BACKGROUND OF THE INVENTION

1. Field of the Invention

This invention relates to a coaxial multicore receptacle for connection of coaxial contacts to a number of signal pins set upright on a substrate.

2. Description of the Prior Art

The system is known wherein a plurality of signal pins provided on a substrate are supplied respectively with input signals, these input signals are processed in a circuit provided on the substrate, and a plurality of resulting signals are output through signal pins provided also on the substrate. In such a system, as the transmission rate of the input and/or output signal becomes high a coaxial cable must be used for transmission of these signals. In such a case, a coaxial connector for connection of the coaxial cable is mounted on the substrate in the prior art. The coaxial connector is suited for connection with the coaxial cable and can shield the signal sufficiently from external noise; but, it is expensive, large in dimension and is troublesome to connect. Accordingly, in case a number of coaxial connectors have to be mounted on the substrate, the system becomes a remarkably large, expensive unit and needs a number of processing steps to effect the desired connections.

In contrast to the above, another system can be envisioned wherein a number of signal pins that are set upright on the substrate and a coaxial contact, having a structure similar to that of the coaxial cable, but smaller in size, is simply fitted and connected to the signal pin via its center conductor. In such a system, however, an outer conductor does not exist in a connected section between the signal pin and the coaxial contact, so that if the signal pins are located mutually closely adjacent to one another, crosstalk occurs between signals on adjacent signal pins. Because of the above, a coaxial multicore receptacle having a number of signal pins provided mutually closely and in which a coaxial contact is connected easily without giving rise to a crosstalk problem, has been unknown prior to the present invention.

SUMMARY OF THE INVENTION

It is the object of the present invention to provide a coaxial multicore receptacle which is miniaturizable even if a comparatively large number of coaxial contacts are to be connected therewith, can reduce remarkably crosstalk between connection elements, and is simplified in structure and easy to connect.

In brief, according to the present invention, a plurality of ground pins are arranged in a matrix pattern and set upright on a substrate, and a plurality of signal pins are set upright on the substrate, each signal pin being located at about the center of each unit square area that is surrounded by adjacent rows and adjacent columns of the ground pin matrix pattern. First metallic lattice boards are provided perpendicularly to the substrate each being located correspondingly to and above each column of the ground pins, and second metallic lattice boards are also provided perpendicularly to the substrate each being located correspondingly to and above each row of the ground pins. The first lattice boards and second lattice boards cross one another orthogonally to define square coaxial contact insertion holes arranged in the matrix pattern which are surrounded by both lattice boards, each signal pin being located at the axial center position of each coaxial contact insertion hole.

Each first lattice board is formed with notches extending inward from the rear edge of the board on the side of the substrate to provide ground pin contact springs corresponding to the ground pins, each ground pin contact spring coming into elastic contact with the corresponding ground pin. Each portion between adjacent ground pin contact springs of the first lattice board defines a coaxial ground spring which is designed so that as a coaxial contact is inserted into the coaxial contact insertion hole, the coaxial ground spring is brought into elastic contact with an outer conductor of the coaxial contact with a center conductor of the inserted coaxial contact coming into contact with the signal pin. Each of the first lattice boards is formed with first kerfs extending from its front edge toward the substrate along a line passing through each ground pin spring, each of the second lattice boards is formed with second kerfs extending from its rear edge on the side of the substrate in the direction of separating from the substrate on each row position of the ground pins, the portion of each second lattice board opposite to the substrate is inserted and coupled in the first kerfs, and the portion of each first lattice board on the side of the substrate is inserted and coupled in the second kerfs.

Each of the first lattice boards is composed of two metallic plates joined back to back, so that each of the ground pin contact springs is made of a pair of mutually opposing spring segments between which the corresponding ground pin is inserted. Similarly, each of the coaxial ground springs is made of a pair of mutually opposing spring segments, which are separated from each other and portions of which are positioned in the coaxial contact insertion holes on either side thereof.

A guide board made of insulating material is interposed between the substrate and the first and second lattice boards. In the guide board there are bored ground pin insertion thru-holes through which the ground pins pass, and signal pin insertion thru-holes through which the signal pins pass. The guide board, first lattice boards and second lattice boards are disposed in and maintained by an outer frame. Therefore, the outer frame supporting the guide board, first lattice boards and second lattice boards may be designed so that it can be mounted on a substrate on which the foregoing pins are set upright.

Each portion between adjacent second kerfs of each second lattice board is shaped to provide a driving segment, the side edges of which are positioned so as to push the ground pin contact springs against the ground pins. Each of the second lattice boards is held by the outer frame retractably with respect to the guide board. In assembling the unit, the second lattice boards are initially spaced from the guide board, the outer frame is attached to the substrate, each ground pin is inserted between the corresponding ground pin spring segments, and thereafter the second lattice boards are shifted in position toward the substrate, whereby the ground pin springs are put in sufficient pressure contact with the ground pins by means of the driving segments on the second lattice boards.

DESCRIPTION OF THE PREFERRED EMBODIMENT

An embodiment of the present invention will now be described with reference to the drawings.

Figure 1:
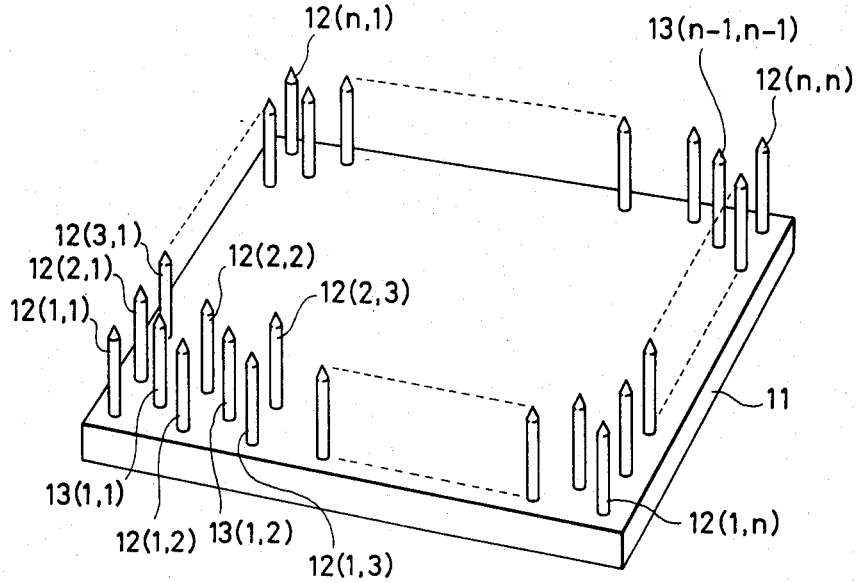
FIG. 1 is a perspective view showing a substrate, ground pins and signal pins.
Figure 11:
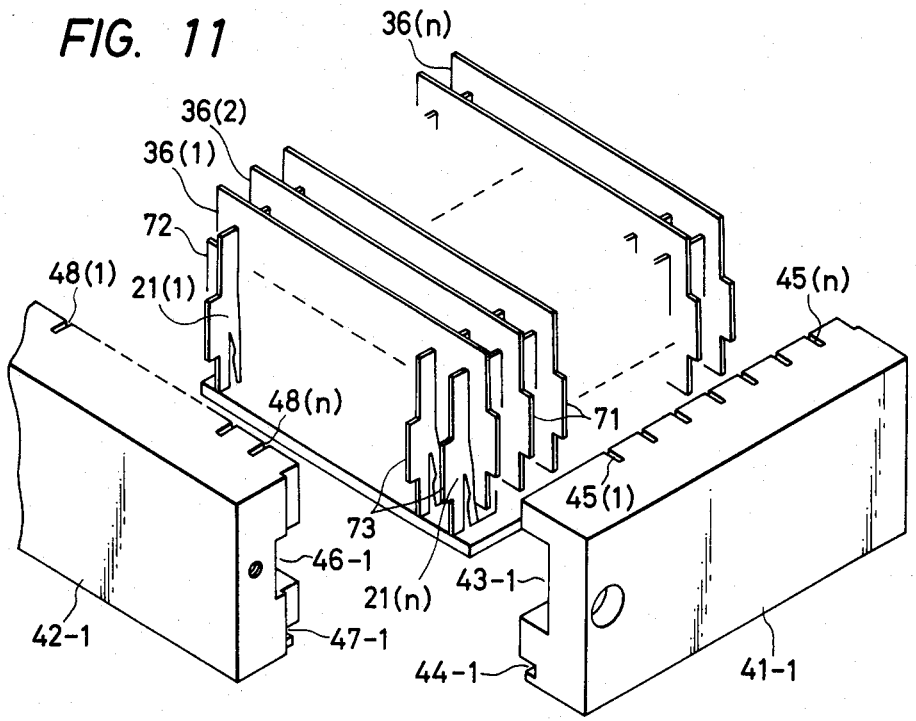
FIG. 11 is an exploded perspective view showing the relation between the lattice boards 21(*s*), 36(*p*) and an outer frame 41.
Figure 13:
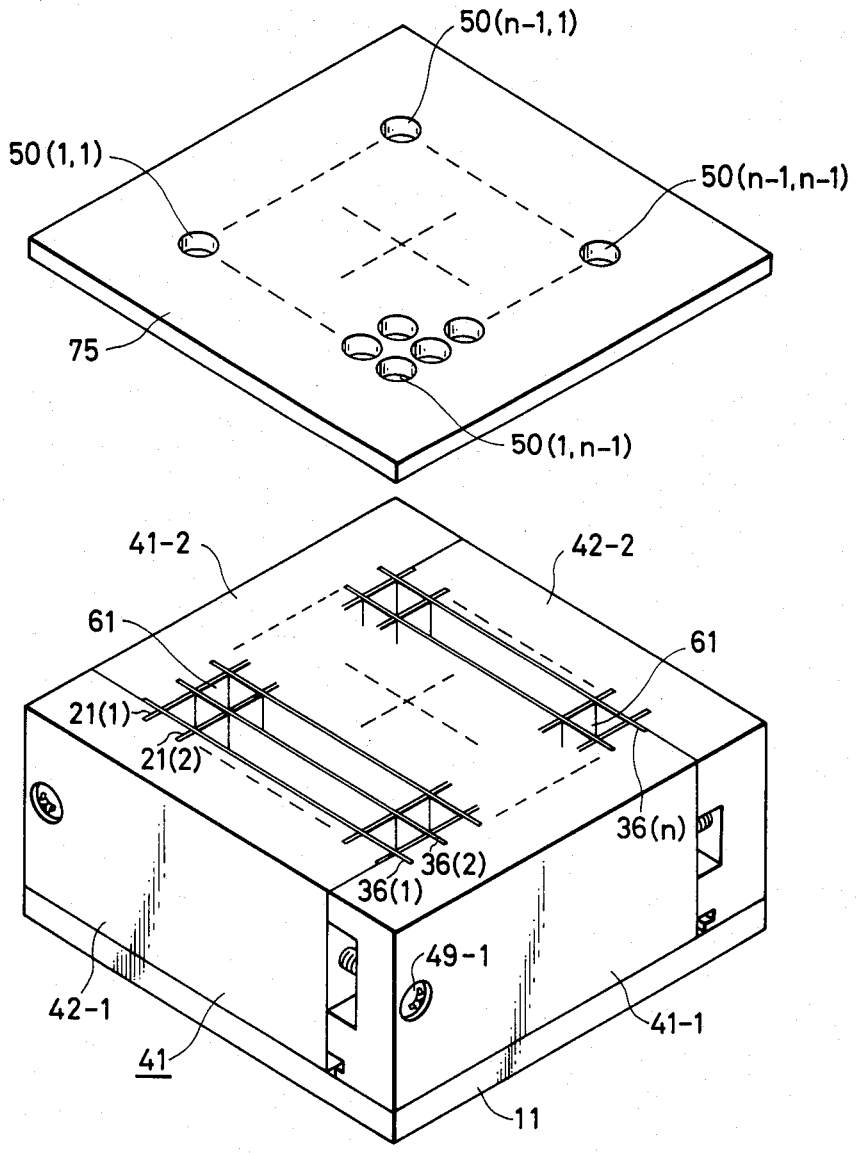
FIG. 13 is a perspective view corresponding to FIG. 12, except that the substrate 11 is attached to, and an indication board 75 is spaced from, the unit.

As shown in FIG. 1, a large number of ground pins 12(1,1) through 12(*n,n*) and signal pins 13(1,1) through 13($n-1,n-1$) are set upright on an insulating substrate 11. As shown in FIG. 11, metallic lattice boards 21(1) through 21(*n*) are arranged side by side at a regular interval and other metallic lattice boards 36(1) through 36(*n*) are also arranged side by side at a regular interval and disposed so as to cross orthogonally the lattice boards 21(1) through 21(*n*) As shown in FIG. 13, these lattice boards 21(1) through 21(*n*) and 36(1) through 36(*n*) form a matrix pattern composed of square holes 61 for insertion of coaxial contacts. The lattice boards 21(1) through 21(*n*) and 36(1) through 36(*n*) are surrounded and maintained by side frames 41-1 through 42-2, the lattice boards and side frames are mounted on the substrate 11 shown in FIG. 1, and each signal pin is located inside a respective one of the coaxial contact insertion holes 61.

Figure 2:
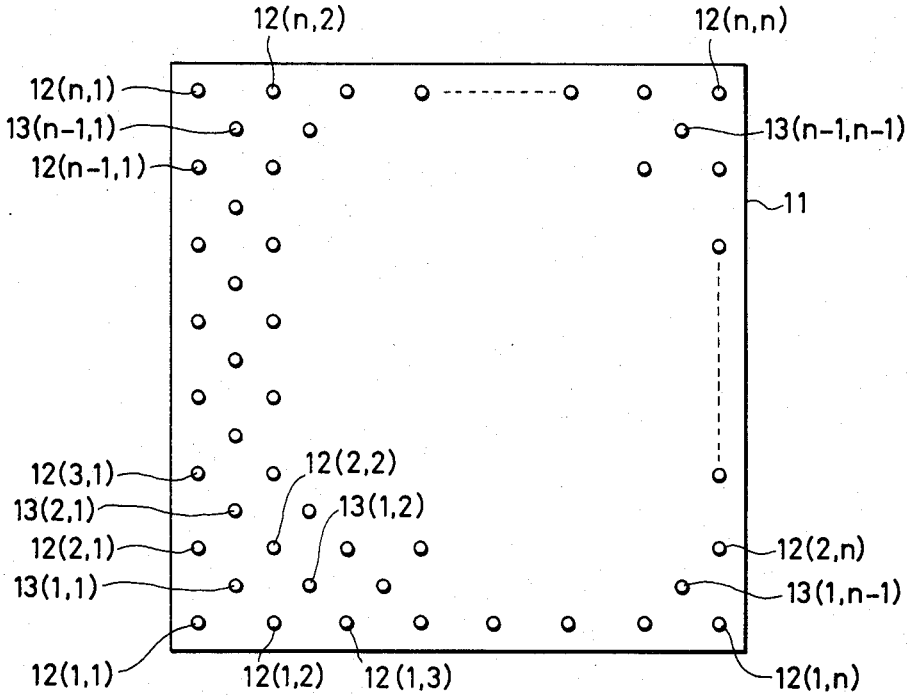
FIG. 2 is a plan view corresponding to FIG. 1.

As shown in FIGS. 1 and 2, the substrate 11 made of insulator, such as synthetic resin, is shaped substantially square. On the substrate 11 the ground pins 12(1,1) through 12(*n,n*) are arranged in a square matrix pattern and set upright. At about the center of each unit square area enclosed by adjacent rows and adjacent columns of the ground pins of the matrix pattern, each signal pin 1,1) through 13($n-1,n-1$) is set upright on the substrate 11. Although not shown, on the substrate 11 a signal processing circuit will be provided, for example, whose ground lines will be connected to the respective ground pins 12(1,1) through 12(*n,n*) and whose input-/output terminals will be connected to respective signal pins 13(1,1) through 13($n-1,n-1$), or, pins and/or sockets (also not shown) will be provided on the opposite side of the substrate 11 to the signal pins 13(1,1) through 13($n-1,n-1$) and connected to those signal pins, which in turn will be connected through connecting means to LSI elements, for example.

The illustrated embodiment includes a guide board 14 interposed between the substrate 11 and the lattice boards 21(*s*) (s=1, 2, . . . , n) and 36(*p*) (p=1, 2, . . . , n).

Figure 3:
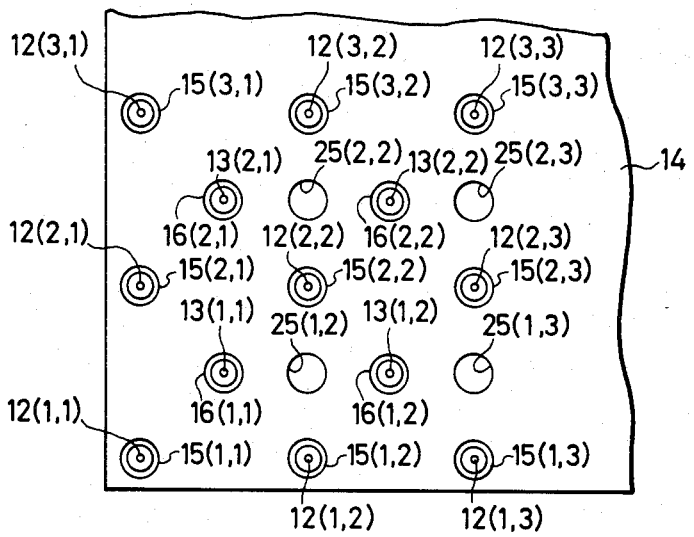
FIG. 3 is a plan view showing part of a guide board 14 through which the ground pins and signal pins pass.

As shown partially in FIG. 3, in this guide board 14 there are bored ground pin thru-holes 15(1,1) through 15(*n,n*) through which the ground pins 12(1,1) through 12(*n,n*) pass respectively, and signal pin thru-holes 16(1,1) through 16($n-1,n-1$) through which the signal pins 13(1,1) through 13($n-1,n-1$) pass respectively. As shown partially in FIGS. 5 and 6, the inner periphery of each of the ground pin thru-holes 15(1,1) through 15(*n,n*) and signal pin thru-holes 16(1,1) through 16($n-1,n-1$) is tapered and enlarged as it approaches the substrate 11 so that the ground pins 12(1,1) through 12(*n,n*) and signal pins 13(1,1) through 13($n-1,n-1$) can pass smoothly through the thru-holes.

Figure 10:
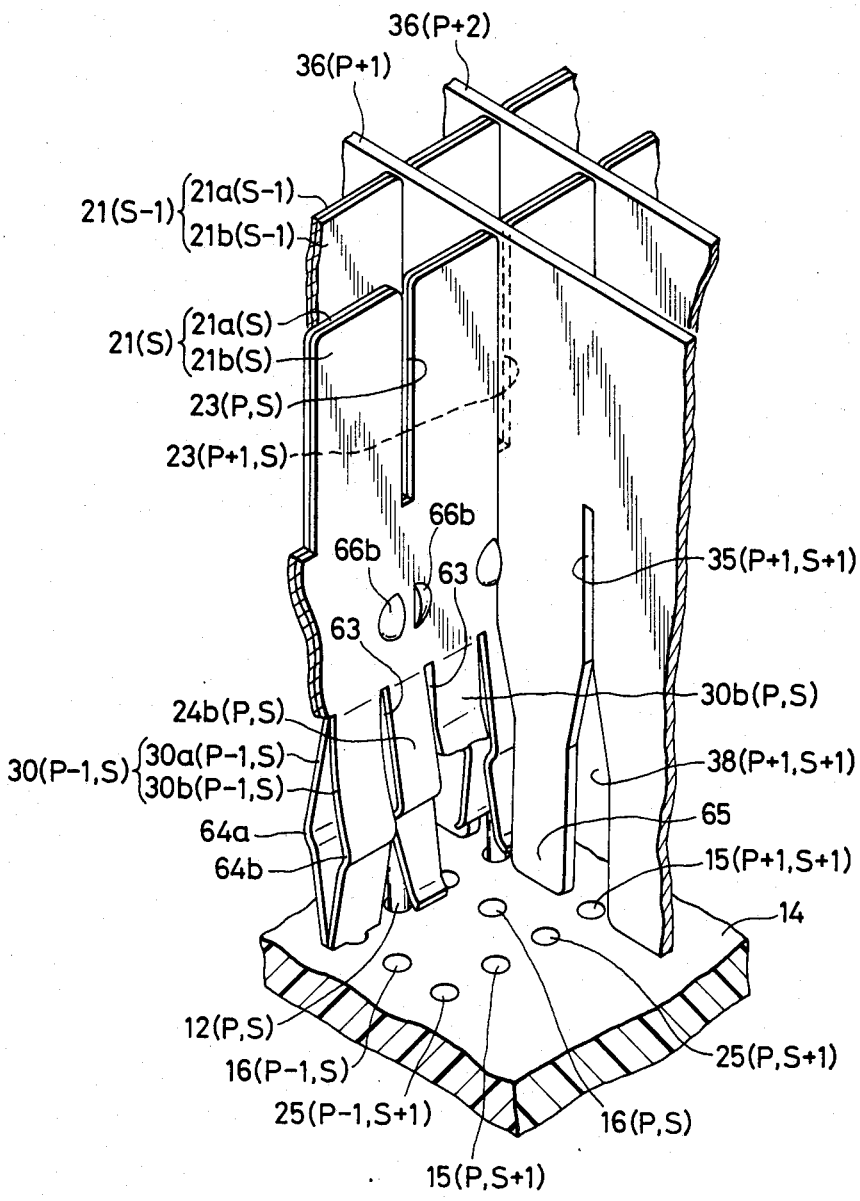
FIG. 10 is a perspective view showing part of the lattice boards 21(*s*), 36(*p*) arranged on the guide board 14.

As shown in FIG. 10, the lattice boards 21(*s*) of the embodiment are designed so that each board is composed of two conductive plates 21*a*(*s*), 21*b*(*s*) joined back to back. The lattice board 21(*s*) is shaped substantially rectangular in appearance and formed with kerfs 23(*p,s*) extending from the front edge (upper edge in FIG. 10) toward the guide board 14 mutually parallelly at a regular interval. On the extended lines of the kerfs 23(*p,s*) (p=1, 2, . . . n) the ground pin thru-holes 15(*p,s*) are located.

Figure 5:
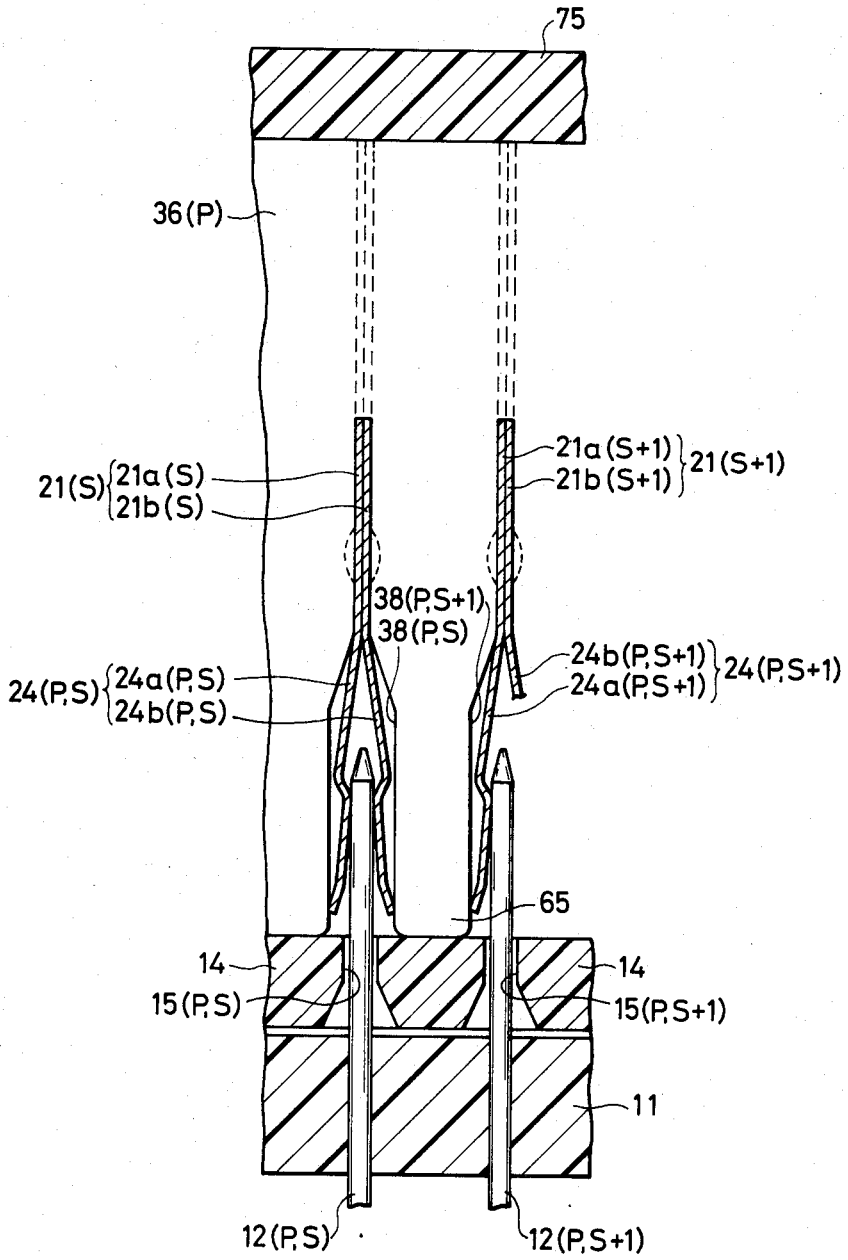
FIG. 5 is a cross sectional view taken along line V—V in FIG. 4.
Figure 7:
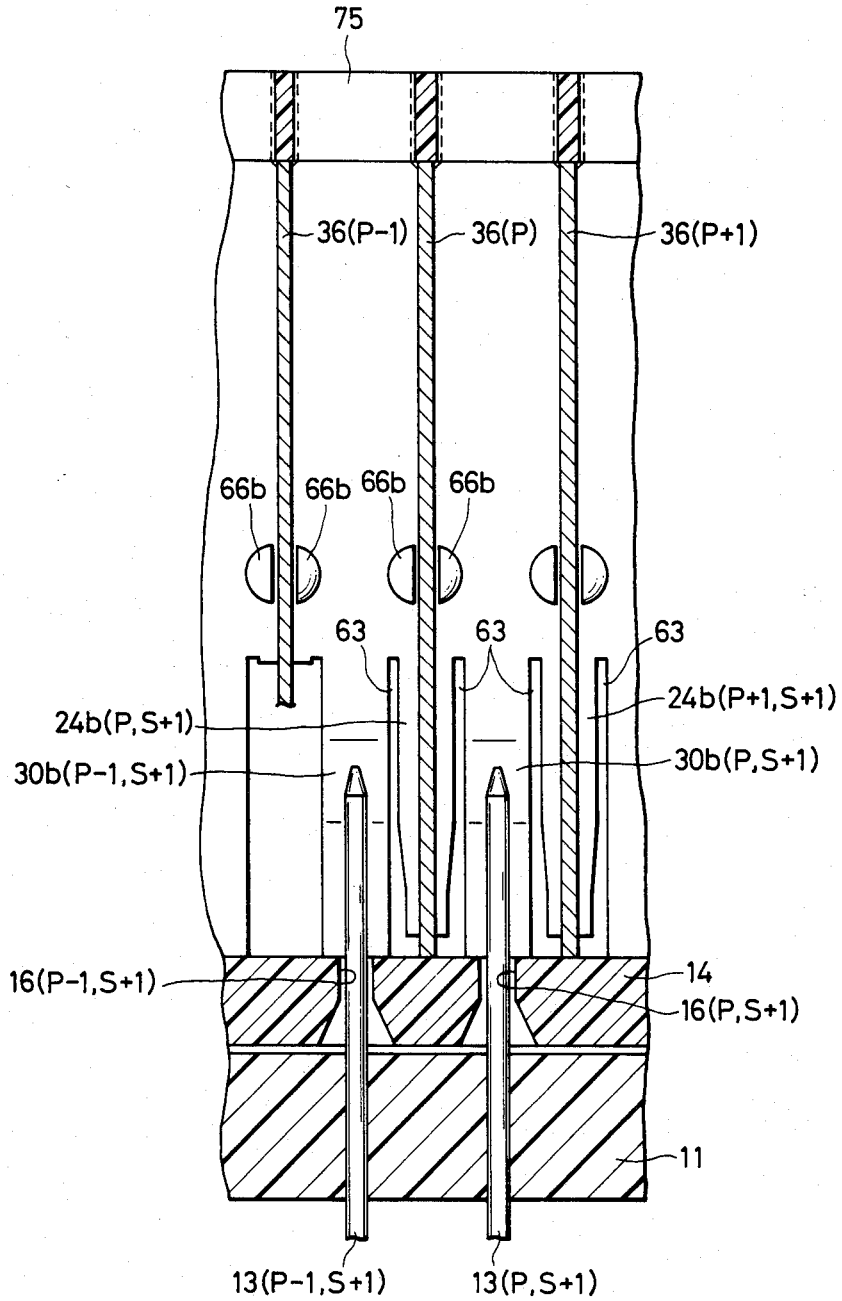
FIG. 7 is a cross sectional view taken along line VII—VII in FIG. 4.

In the rear edge of the lattice board 21(*s*) on the side of the guide board 14 contact springs 24(*p,s*) for the ground pins are formed which come into elastic contact with the ground pins 12(*p,s*). Specifically, as shown in FIGS. 7 and 10, notches 63 are formed in the rear edge of the lattice board 21(*s*) on the side of the guide board 14 so as to oppose both sides of each ground pin thru-hole 15(*p,s*). Spacing between adjacent notches 63 is uniform, whereby each ground pin contact spring 24(*p,s*) is provided opposite to the corresponding ground pin thru-hole 15(*p,s*). Each ground pin contact spring 24(*p,s*) is made integrally with the conductive plates 21*a*(*s*), 21*b*(*s*) and composed of mutually opposing spring segments 24*a*(*p,s*), 24*b*(*p,s*). Specifically, as shown in FIGS. 5 and 10, the spring segments 24*a*(*p,s*), 24*b*(*p,s*) separate gradually from each other as they approach the guide board 14, then come close together abruptly, and separate gradually again. The ground pin 12(*p,s*) is elastically clamped between the approached or closed portions of the spring segments. The free ends of the spring segments 24*a*(*p,s*), 24*b*(*p,s*) are spaced from each other so that the ground pin 12(*p,s*) can fit easily between the spring segments.

Figure 6:
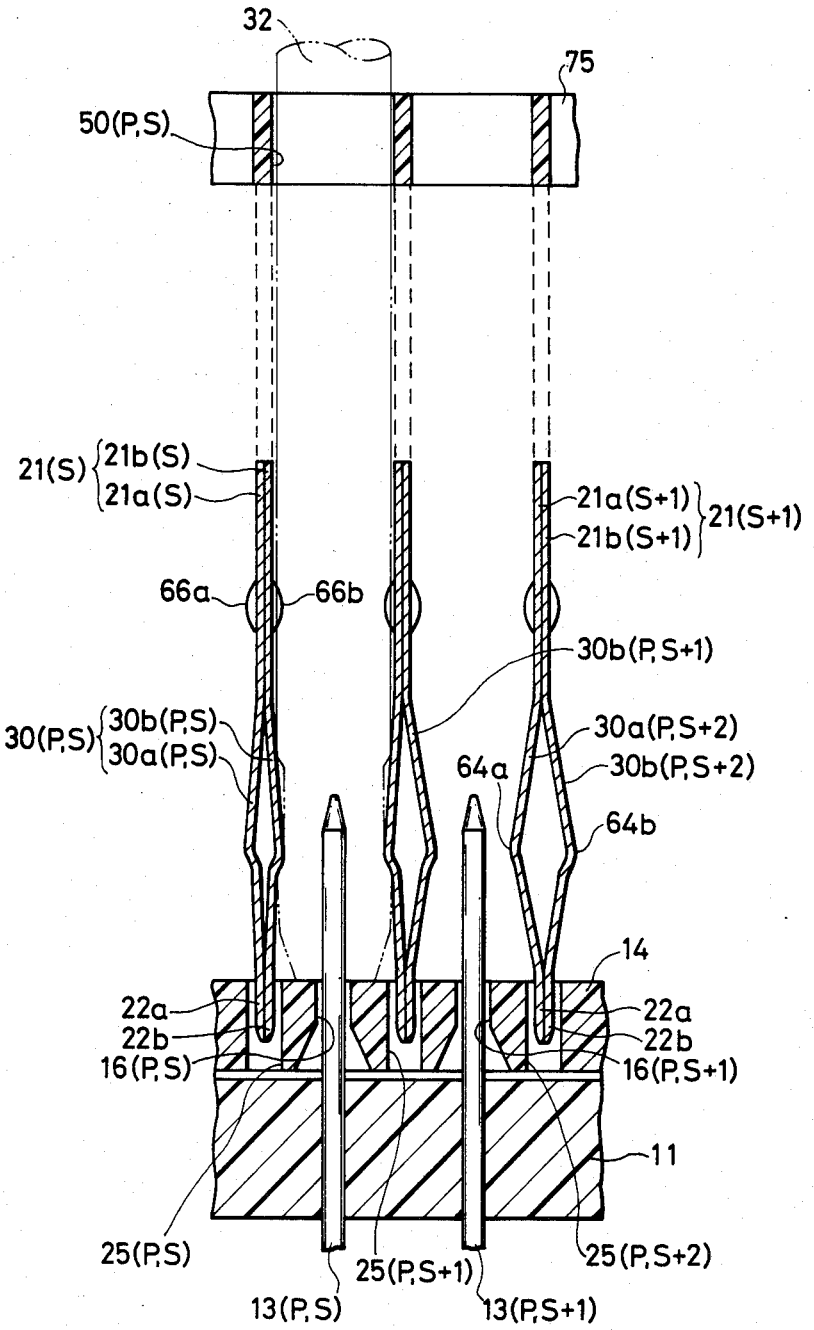
FIG. 6 is a cross sectional view taken along line VI—VI in FIG. 4.

In the embodiment, each portion between adjacent ground pin contact springs 24(*p,s*) and 24($p+1,s$) is defined as a coaxial ground spring 30(*p,s*). Each coaxial ground spring 30(*p,s*) is composed of spring segments 30*a*(*p,s*), 30*b*(*p,s*) which are extensions of the conductive plates 21*a*(*s*), 21*b*(*s*). As shown in FIGS. 6 and 10, the midway portions in the lengthwise direction of the spring segments 30*a*(*p,s*), 30*b*(*p,s*) are spaced from each other and forming coupling projections 64*a*, 64*b* which are located respectively on one side each of adjacent coaxial contact insertion holes 61.

On the free ends of the spring segments 30*a*(*p,s*), 30*b*(*p,s*) narrow portions 22*a*, 22*b* are formed projectingly which are inserted in a coupling hole 25(*p,s*) bored in the guide board 14 between adjacent signal pin thru-holes 16($p,s-1$) and 16(*p,s*) so that the coaxial ground spring 30(*p,s*) is positioned correctly. For a clear understanding of the structure one of the coaxial ground springs 30(*p,s*) is cut off in FIG. 10.

In the embodiment, the lattice boards 36(*p*) intersect orthogonally the lattice boards 21(*s*), in the rear edges of the lattice boards 36(*p*) on the side of the guide board 14 kerfs 35(*p,s*) are formed correspondingly to the ground pin thru-noles 15(*p,s*), the rear edge portions of the lattice boards 36(*p*) are fitted and coupled in the kerfs 23(*p,s*), and the front edge portions of the lattice boards 21(*s*) are fitted and coupled in the kerfs 35(*p,s*). In this mutually fitted and coupled state the inner-ends of the kerfs 23(*p,s*) coincide with the inner ends of the kerfs 35(*p,s*) in level.

The open end portion of each of the kerfs 35(*p,s*) formed in the lattice boards 36(*p*) on the side of the guide board 14 is enlarged widthwise to form a substantially rectangular notch 38(*p,s*).

Figure 8:
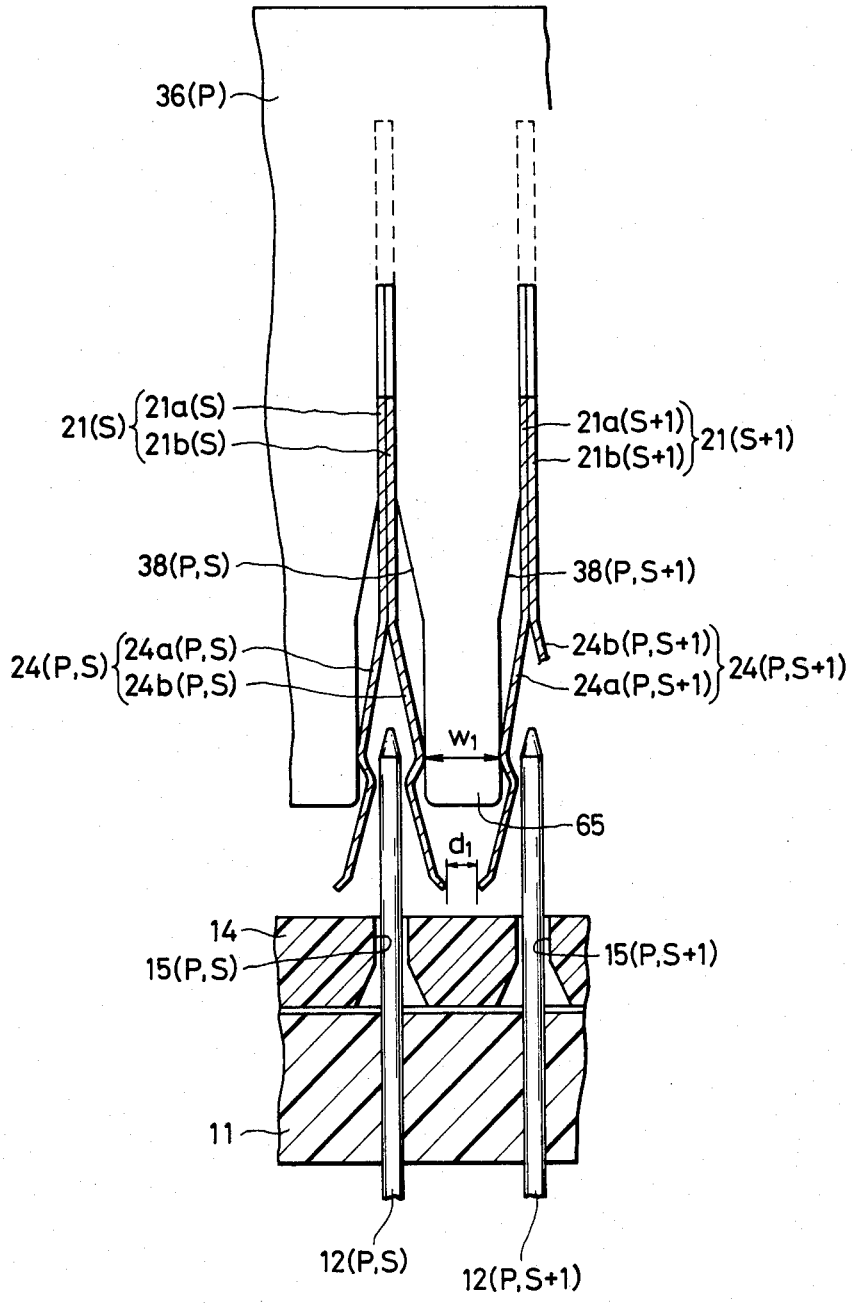
FIG. 8 is a cross sectional view identical to FIG. 5, except that the lattice boards 36(*p*) are spaced a little from the guide board 14.
Figure 9:
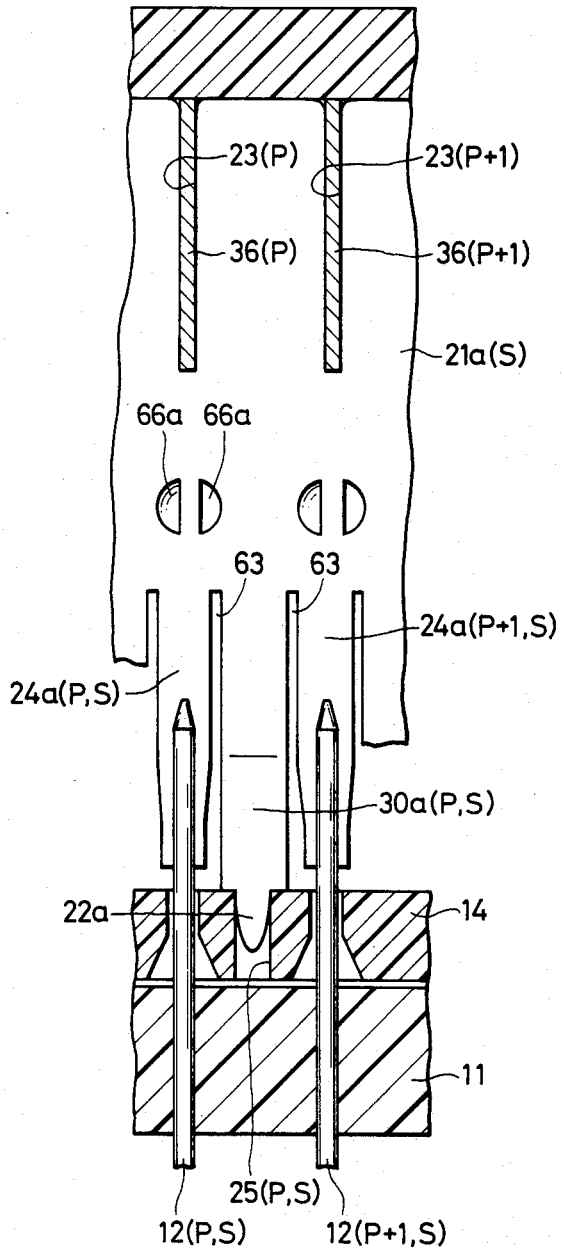
FIG. 9 is a cross sectional view taken along line IX—IX in FIG. 4.

In order to get a good electrical contact when the ground pins 12(*p,s*) are inserted so as to come into contact with the ground pin contact springs 24(*p,s*), a sufficient frictional force is desirable between them. However, as the number of the ground pins increases the total force of friction becomes too large. Therefore, in the embodiment, the ground pins 12(*p,s*) are inserted and positioned between the spring segments 24*a*(*p,s*) and 24*b*(*p,s*) before fully inserting the lattice boards 36(*p*) as shown in FIG. 8 so that substantially no pressure is needed for insertion of the pins 12(*p,s*), and thereafter the spring segments 24*a*(*p,s*), 24*b*(*p,s*) are then forced to be pushed elastically against the ground pins 12(*p,s*) by fully inserting the lattice boards 36(*p*) which are made retractable with respect to the guide board 14. That is to say, when the lattice boards 36(*p*) are spaced from the guide board 14 more than a given distance as shown in FIG. 8, the driving segments 65 and the ground pin spring segments 24*a*(*p,s*), 24*b*(*p,s*) are not in engagement with one another, or are only in weak engagement with one another, and the ground pin spring segments 24*a*(*p,s*), 24*b*(*p,s*) are separated from the ground pins 12(*p,s*) or only slightly in contact therewith. Accordingly, in the state where the lattice boards 21(*s*) alone are located at ultimately expected positions with respect to the guide board 14, each ground pin 12(*p,s*) can be inserted and positioned between the spring segments 24*a*(*p,s*), 24*b*(*p,s*) with no insertion force.

Portions of each lattice board 36(*p*) between adjacent notches 38(*p,s*) and 38(*p,s*+1) are defined as driving segments 65, and the gap $d_1$ between the free ends of spring segments 24*b*(*p,s*) and 24*a*(*p,s*+1) opposite to the edges of each driving segment 65, in the position shown in FIG. 8, is narrower than the width $w_1$ of the driving segment 65. Accordingly, as the lattice boards 36(*p*) are shifted close to the guide board 14 to a given extent, the gap between the spring segments 24*b*(*p,s*) and 24*a*(*p,s*+1) on both sides of the driving segment 65 is widened by the driving segment 65, as shown in FIG. 5, whereby the ground pins 12(*p,s*) are clamped elastically by the pairs of spring segments 24*a*(*p,s*), 24*b*(*p,s*) and a good electrical contact is obtained therebetween. By shifting the lattice boards 36(*p*) one after another or several at a time from the position shown in FIG. 8 to the position shown in FIG. 5 each ground pin 12(*p,s*) can be put in good contact with the ground pin contact spring without requiring a large force.

As guide means which become effective when the lattice boards 36(*p*) are fitted in and shifted relatively with respect to the lattice boards 21(*s*), substantially hemispherical projections 66*a*, 66*b* are formed in opposing relation to each other on both sides of the lattice boards 21(*s*) as shown in FIGS. 6 and 10 through pressing, the said projections being located in a midway position between the kerfs 23(*p,s*) and the ground pin contact springs 24(*p,s*) of the latt boards 21(*s*) so as to guide the lattice boards 36(*p*) therebetween.

Figure 12:
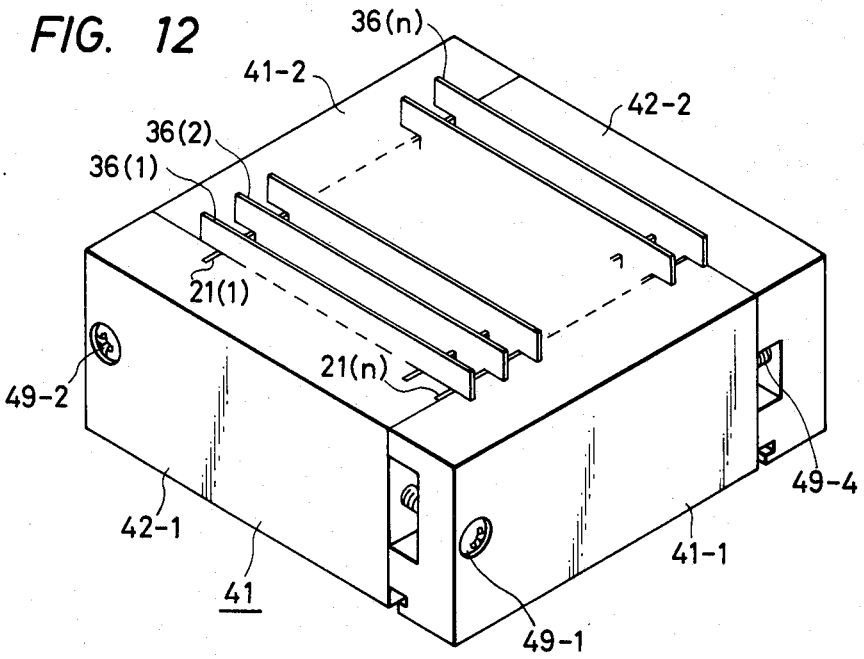
FIG. 12 is a perspective view showing the guide board 14 and lattice boards 21(*s*), 36(*p*) assembled in the outer frame 41.

As shown in FIG. 11, the lattice boards 21(*s*), 36(*p*), and guide board 14 are surrounded by side frame elements 41-1, 41-2, 42-1, 42-2 (the latter two, 42-1, 42-2, are shown in FIG. 12) of the outer frame 41 and supported thereby.

In the inner surfaces of the side frame elements 41-1, 41-2 concave portions 43-1, 43-2 (43-2 not shown) are formed extending longitudinally, and below and along the concave portions 43-1, 43-2 fixing grooves 44-1, 44-2 (44-2 not shown) are formed in which the marginal edge portions of the guide board 14 are inserted. In inner upper edge portions of the side frame elements 41-1, 41-2 kerfs 45(*p*) ($p=1, 2, \ldots n$) are formed to reach the concave portions 43-1, 43-2, and the end portions of the lattice boards 36(*p*) are inserted in the kerfs 45(*p*).

The side frame elements 42-1, 42-2 are to be mounted orthogonally to the side frame elements 41-1, 41-2. Similarly, they have formed therein concave portions 46-1, 46-2, fixing grooves 47-1, 47-2, and kerfs 48(*s*) ($s=1, 2, \ldots n$) in which the end portions of the lattice boards 21(*s*) are inserted.

On either end of each of the lattice boards 21(*s*)and 36(*p*) projection segments 71, 72, 73, 74 (74 not shown) are formed which are inserted and coupled in the concave portions 43-1, 43-2, 46-1, 46-2, respectively.

In assembling, the peripheral portion of the guide board 14 is inserted in the fixing grooves 44-1, 44-2, 47-1, 47-2, the projection segments 71, 72, 73, 74 are inserted respectively in the concave portions 43-1, 43-2, 46-1, 46-2 so that the side frame elements 41-1, 41-2, 42-1, 42-2 are attached to the periphery of the lattice boards 36(*p*) and lattice boards 21(*s*) as shown in FIG. 12, and adjacent ones of the side frame elements 41-1, 41-2, 42-1 and 42-2 are secured together at their ends by screws 49-1 through 49-4 (49-3 not shown), thereby resulting in the assembled outer frame 41 consisting of side frame elements 41-1, 41-2, 42-1, 42-2. At this stage, the lattice boards 36(*p*) are assembled; but spaced a little from the guide board 14 as shown in FIG. 8. The guide board 14 is then pushed against the substrate 11 to stake the narrow portions 22*a*, 22*b* of the coaxial ground springs 30(*p,s*) into the corresponding coupling holes 25(*p,s*). Then, the substrate 11 is mounted on the guide board 14 so that the ground pins and signal pins pass through the thru-holes of the guide board 14 thereby positioning the ground pins in between the corresponding spring segments. Thereafter, the lattice boards 36(*p*) are pushed in completely one after another or several at a time as shown in FIG. 13, thereby resulting in the position shown in FIG. 5.

When necessary, an indication board 75 is disposed so as to cover the upper side of the unit and secured to the substrate 11 and outer frame 41 together. In the indication board 75 thru-holes 50(1,1) through 50($n-1$,$n-1$) are bored at positions corresponding to the signal pins 13(1,1) through 13($n-1$,$n-1$). If addresses indicating the coaxial contacts to be inserted are presented in connection with the thru-holes 50(1,1) through 50($n-1$,.$n-1$), these indicated addresses are convenient for connection work. For indication, different colors may be used for different groups of signals, for example.

In case the number of the ground pins is as much as one thousand, for example, the substrate 11 and outer frame 41 can be secured and maintained together only by the frictional force existing between the ground pins and ground pin spring segments. If necessary, appropriate locking means may be used; for example, bolts can be inserted through the outer frame 41 and substrate 11 and secured by nuts to clamp them together.

Figure 4:
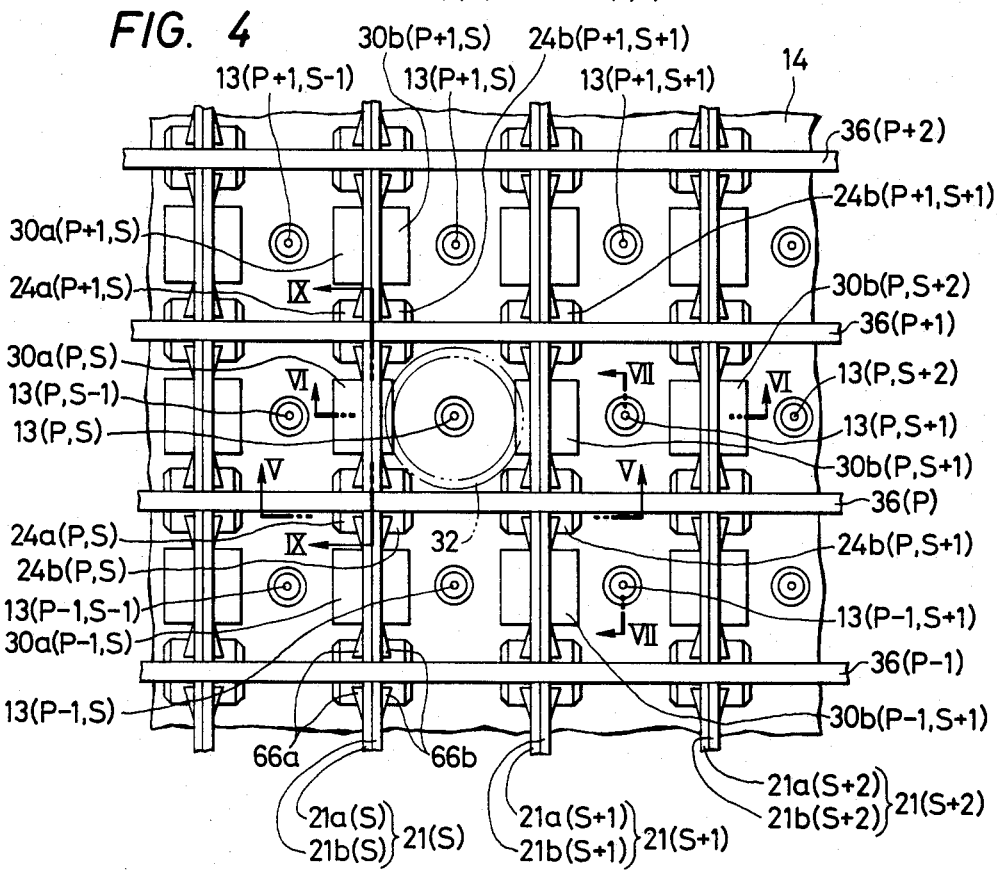
FIG. 4 is a plan view showing part of lattice boards 21(*s*), 36(*p*) arranged on the guide board.

In the assembled state, as a coaxial contact 32 is inserted in one thru-hole, for example, 50(*p,s*), as shown in FIGS. 4 and 6, the coaxial ground spring segments 30*b*(*p,s*) and 30*a*(*p,s*+1) are elastically deformed by an outer conductor on the periphery of the coaxial contact 32 and come into mutual contact therewith. A center conductor (not shown) of the coaxial contact 32 is made in the form of a female contact; thus, as the signal pin 13(*p,s*) is inserted in this female contact, they come into elastic contact with each other. At this step, the coupling projections 64*b*, 64*a* of the coaxial ground spring segments 30*b*(*p,s*), 30*a*(*p,s*+1) are fitted in and coupled elastically with a ring-shaped coupling recess formed on the periphery at the end portion of the coaxial contact 32, whereby an operator can feel the click reaction of insertion of the coaxial contact 32 and this contacted state is maintained.

As is apparent from the foregoing, the coaxial multicore receptacle according to the present invention has a comparatively simple structure and can easily be attached and assembled to the substrate on which the signal pins and ground pins are set upright. In the assembled state, the outer conductors of the coaxial contacts being connected to a number of signal pins set upright on the substrate are surrounded by the lattice boards 21(*s*), 36(*p*) and connected to and kept in contact with the coaxial ground springs, and each connected section is electrically shielded sufficiently from others.

Accordingly, in the present invention, the signal pins can be located closely adjacent to one another, the receptacle can be fabricated in the form of a small-sized unit even though a large number of signal pins are to be included, and it can be produced at low cost in comparison to the conventional receptacle using coaxial connectors. Further, even if a large number of ground pins are included in the unit, the ground pins and ground pin springs can be put in contact with each other under sufficient pressure by pushing in a little the lattice boards 36(*p*) one after another or several at a time after assembled.

What is claimed is:

1. A coaxial multicore receptacle comprising:

a substrate made of insulating material, a plurality of gorund pins set upright and arranged in a matrix pattern of rows and columns in said substrate, a plurality of signal pins set upright on the same side of said substrate as that of said ground pins, each of said signal pins being located at about the center of a unit square area that is defined by two adjacent rows and two adjacent columns of said ground pin matrix pattern, a plurality of first metallic lattice boards provided in parallel to one another at equal intervals substantially perpendicularly to said substrate, each of said first lattice boards being positioned above a corresponding one of the columns of said gorund pins, a plurality of second metallic lattice boards provided in parallel to one another at equal intervals substantially perpendicularly to said substrate and crossing substantially orthogonally said first lattice boards, each of said second boards being positioned above a corresponding one of the rows of said ground pins, coaxial contact insertion holes being defined and surrounded by said second lattice boards and said first lattice baords, which correspond one-to-one to said signal pins, and ground pin contact springs extending from each of said first lattice boards toward said substrate for elastic contact with the ground pins in the column respectively corresponding to said first lattice board.

2. A coaxial multicore receptacle as set forth in claim 1, wherein each of said first lattice boards is formed integrally with coaxial ground springs extending toward said substrate between adjacent ones of said ground pin contact springs, each of said coaxial ground springs coming into elastic contact with an, outer conductor of a coaxial contact that is inserted into the corresponding coaxial contact insertion hole.

3. A coaxial multicore receptacle as set forth in claim 2, wherein each of said first lattice boards is composed of two metallic plates joined back to back, each of said ground pin contact springs is made in the form of a pair of spring segments integral with the two metallic plates of said first lattice board, and by said pair of spring segments the corresponding ground pin is elastically clamped.

4. A coaxial multicore receptacle as set forth in claim 3, wherein each of said coaxial ground springs is made in the form of a pair of spring segments integral with the two metallic plates of said first lattice board, and the paired spring segments are separated from each other and project into the adjacent coaxial contact insertion holes.

5. A coaxial multicore receptacle as set forth in claim 2, wherein each of said first lattice boards is formed with first kerfs extending from a front edge thereof opposite from said substrate toward said substrate along a line passing through each of said ground pin contact springs, each of said second lattice boards is formed with second kerfs extending from the rear edge thereof on the side of said substrate in the direction away from said substrate and in alignment with each of said ground pins arranged in a row, portions of said second lattice boards opposite from said substrate are inserted and coupled in said first kerfs, and portions of said first lattice boards on the side of said substrate are inserted and coupled in said second kerfs.

6. A coaxial multicore receptacle as set forth in claim 5, wherein each of said first lattice boards is formed integrally with pairs of projections positioned between said first kerfs and said ground pin contact springs, for holding the corresponding second lattice board therebetween.

7. A coaxial multicore receptacle as set forth in claim 3, wherein each of said second lattice boards is formed integrally with driving segments extending toward said substrate between adjacent ones of said ground pins arranged in a row, the paired spring segments of each of said ground pin contact springs are formed with projections separated from each other, said projections are elastically pushed by edges of said driving segments, and said projections and said driving segments are designed so that when said first lattice boards and said second lattice boards are assembled together, except for said second lattice boards being displaced a little away from said substrate, the pushing force of said driving segments against said spring segments is weak or nonexistent.

8. A coaxial multicore receptacle as set forth in claim 4, including further a guide board made of insulating material positioned opposite to said substrate and formed with thru-holes arranged in rows and columns through which said ground pins and said signal pins pass.

9. A coaxial multicore receptacle as set forth in claim 8, wherein each of said first lattice boards, each of said second lattice boards, and said guide board are disposed in and held by an outer frame made of insulating material.

10. A coaxial multicore receptacle as set forth in claim 9, wherein the end portion of each of said coaxial ground springs is inserted in a corresponding coupling hole bored in said guide board.

11. A coaxial multicore receptacle as set forth in claim 9, wherein each of said thru-holes of said guide board is tapered so that the diameter of said thru-hole increases in a direction approaching said substrate.

12. A coaxial multicore receptacle comprising first metallic lattice boards disposed side by side at a substantially regular interval, second metallic lattice boards disposed side by side at a substantially regular interval, crossing substantially orthogonally said first lattice boards, and defining together with said first lattice boards coaxial contact insertion holes of a square shape arranged in a matrix pattern into which coaxial contacts are to be inserted, ground pin contact springs formed at one edge of each of said first lattice boards integrally therewith at the crossing positions between said first lattice boards and said second lattice boards, a guide board made of insulating material, said guide board being located close to and opposite to the free ends of said ground pin contact springs and having ground pin thru-holes therein at positions opposite to the crossing points between said first lattice boards and said second lattice boards, said ground pin thru-holes being arranged in a matrix pattern of rows and columns, and said guide board also having signal pin thru-holes therein each of which is located respectively at about the center of one of the unit square areas that is defined by two adjacent rows and two adjacent columns of said ground pin thru-hole matrix pattern, each of said first lattice boards composed of two metallic plates joined back to back, each of said ground pin contact springs comprising a pair of mutually opposing spring segments formed integrally with the two metallic plates of said first lattice board, the free ends of said paired spring segments being separated from each other to define a gap opposing the corresponding ground pin thru-hole, and an outer frame of insulating material for holding therein said first lattice boards, said second lattice boards and said guide board.

13. A coaxial multicore receptacle as set forth in claim 12, wherein each portion between adjacent ground pin contact springs of said first lattice board defines a coaxial ground spring, each of said coaxial ground springs is made in the form of a pair of spring segments integrally with said two metallic plates, and said paired spring segments are separated from each other and projecting into the adjacent coaxial contact insertion holes.

14. A coaxial multicore receptacle as set forth in claim 13, wherein the free end portions of said paired spring segments of said coaxial ground spring are close to each other and inserted into a corresponding common coupling hole provided in said guide board thereby to be positioned.

15. A coaxial multicore receptacle as set forth in claim 13, wherein each of said first lattice boards is formed with first kerfs extending from the edge thereof opposite from said guide board toward said guide board along a line passing through each of said ground pin contact springs, each of said second lattice boards is formed with second kerfs opposite the corresponding ground pin thru-holes which extend from the edge on the side of said guide board in the direction away from said guide board, portions of said second lattice boards opposite from said guide board are inserted and coupled in said second kerfs.

16. A coaxial multicore receptacle as set forth in claim 15, wherein each end portion between adjacent kerfs of said second lattice board defines a driving segment, the side edges of said driving segment being in elastic contact with adjacent ones of said ground pin contact springs.

17. A coaxial multicore receptacle as set forth in claim 16, wherein said second lattice boards are held in said outer frame retractably with respect to said guide board, the configurations of said driving segments and said ground pin contact springs being such that the strength of elastic contact between said driving segments and said ground pin contact springs is smaller when said second lattice boards are at positions spaced a little from said guide board than is the case when said second lattice boards are moved from said spaced positions closer to said guide board.

18. A coaxial multicore receptacle as set forth in claim 15, including further an indication board bored with holes corresponding one-to-one to said coaxial connector insertion holes, said indicating board being mounted on said outer frame on the side of said frame opposite to said guide board and bearing numerals and/or symbols for designation in connection with said holes.

* * * * *